US005464170A

United States Patent [19]

Mitchell et al.

[11] Patent Number: 5,464,170

[45] Date of Patent: Nov. 7, 1995

[54] TOILET TISSUE ROLL ADAPTOR

[75] Inventors: Joseph Mitchell, Deptford, N.J.; John R. Frassanito, Houston, Tex.

[73] Assignee: Scott Paper Company, Philadelphia, Pa.

[21] Appl. No.: 197,412

[22] Filed: Feb. 16, 1994

[51] Int. Cl.[6] ..... B65H 16/06

[52] U.S. Cl. ..... 242/598; 242/599.1

[58] Field of Search ..... 242/598, 598.3, 242/599, 599.1, 599.3

[56] References Cited

U.S. PATENT DOCUMENTS

| | | | |
|---|---|---|---|
| 1,693,877 | 12/1928 | Uttz, Sr. | 242/598.3 |
| 1,772,917 | 8/1930 | Sifferman | 242/598.1 |
| 2,685,365 | 8/1954 | Sieven . | |
| 2,872,124 | 2/1959 | Sieven . | |
| 3,297,265 | 1/1967 | Turro . | |
| 3,834,636 | 9/1974 | Linick . | |
| 4,103,838 | 8/1978 | Young . | |

*Primary Examiner*—Daniel P. Stodola
*Assistant Examiner*—John P. Darling
*Attorney, Agent, or Firm*—Woodcock, Washburn, Kurtz, Mackiewicz & Norris

[57] ABSTRACT

An adaptor for supporting rolls of toilet tissue of greater than conventional diameter from an existing toilet roll holder designed to support rolls of toilet tissue of conventional diameter. The adaptor includes telescoping mandrel or spindle for rotatably supporting a roll of toilet tissue of greater than conventional diameter. A side member is attached to each end of the spindle, each side member including a journal for insertion into the holes of the existing toilet roll holder. There is a spring biasing the side members away from each other. A slide pin mechanism including a thole is associated with a slot in each of the side members. The slide pin mechanisms are moveable to any position along their respective slots by a user such that the tholes abut against a portion of the existing toilet roll holder to limit the amount of downward pivotal movement of the side members and the spindle.

6 Claims, 3 Drawing Sheets

TOILET TISSUE ROLL ADAPTOR

BACKGROUND OF THE INVENTION

1. Field of the Invention

This invention relates generally to toilet tissue dispensing apparatus and, more particularly, to adaptors for supporting a larger than conventional diameter rolls of tissue in existing roll tissue dispenser support apparatus.

2. Brief Description of the Prior Art

Various adaptors are known in the prior art and have the intent of allowing an existing toilet roll holder to hold more toilet paper than a single roll of toilet paper of conventional diameter. Some of these adaptors are intended to support a single roll having a greater diameter than a conventional roll. Other prior art adaptors are designed to support a supplemental roll from the existing toilet roll holder.

U.S. Pat. No. 4,103,838 to Young teaches a device having a cylinder of fixed length for supporting a roll of toilet tissue. At each end of such cylinder there is an arm having a projection on one end thereof for insertion into an opening in the mounting bracket. One of the arms is connected to the cylinder by means of a hinge and is spring biased to rotate away from the arm at the opposite end of the cylinder. A plurality of set screws are used to adjust the cylinder toward or away from the bracket so as to enable paper rolls of differing diameters to be received in the bracket. Such plurality of set screws also enable the adjustment of the cylinder at a desired elevation.

U.S. Pat. No. 3,834,636 to Linick teaches an adaptor apparatus for supporting rolls of toilet tissue having a larger than standard diameter from an existing toilet roll holder. Such adaptor includes a spring loaded cylinder to support the roll. At each end of such cylinder there is a bar having a plug extending from the distal end thereof for insertion into the openings of the existing toilet holder bracket. Four flexible struts are provided which extend back to contact the wall in which the existing toilet roll holder bracket is mounted. Such flexible struts serve to maintain the bars in a horizontal position.

U.S. Pat. No. 2,872,124 to Sieven teaches a toilet tissue bracket which includes arms for supporting a spare roll of tissue ready for instant use or for supporting a spare roll enclosed in a protective container.

U.S. Pat. No. 3,297,265 to Turro teaches a holder for a reserve roll of toilet tissue. Such holder includes telescoping tubular portion having arms located at each end thereof. The arms include hooks intended to allow the bracket to hang from the existing toilet roll holder mandrel.

U.S. Pat. No. 2,685,365 to Sieven teaches another adaptor to allow the support of a spare roll of tissue from the existing toilet roll holder mandrel. As with the adaptor taught by Turro, Sieven teaches an adaptor having arms with hooked ends allowing the support of the adaptor by the engagement of such hooked ends with the existing mandrel.

From the foregoing, it can be seen that there is little in the prior art which teaches adaptors allowing rolls of larger than conventional diameter to be supported from existing roll tissue holders as of the type commonly used in the residential home. Further, those adaptors which are designed to support larger diameter rolls are either not capable of adjusting to the variety of shapes of existing roll tissue holders which may be encountered, or rely on relatively complicated and unsightly set screw arrangements such as taught by Young. Further, dispenser adapters which would rely on set screw arrangements have the significant disadvantage of not only requiring tools for installation but further, having such set screws applied forcefully against what, in many cases, may be a ceramic fixture. Residential users will not only likely be opposed to the appearance of such set screws, but further, there is the potential for cracking or chipping the permanently affixed ceramic fixture through the installation of the adaptor with such set screws.

SUMMARY OF THE INVENTION

It is therefore an object of the present invention to provide a toilet tissue roll adaptor for use with an existing toilet tissue roll holder which is installable without tools.

It is a further object of the present invention to provide a toilet tissue roll adaptor for supporting larger than conventional diameter rolls of toilet tissue from an existing toilet tissue roll holder which includes adjustable means for supporting the larger roll at the desired elevation with respect to the existing toilet roll holder.

Another object of the present invention is to provide an adjustable toilet roll tissue adaptor for supporting a roll of toilet paper having a greater than conventional diameter from an existing toilet roll holder wherein the mechanism for orientation of such adapter is substantially hidden from the user when the adaptor is installed on an existing roll holder and supporting a roll of tissue.

Briefly stated, these and numerous other features, objects and advantages of the present invention will become readily apparent upon a reading of the specification, claims, and drawings set forth hereinafter. These features, objects and advantages are accomplished by providing a pair of support arms, each of such support arms including a journal projecting therefrom for insertion into the holes of the existing toilet tissue roll holder which are intended to provide residence for the journals of the existing toilet roll holder mandrel. A spring loaded telescoping cylinder is provided for supporting an enlarged diameter roll of tissue, the spring loaded cylinder biasing the support arms away from one another. At least one of the support arms is provided with a slot in which a slide pin mechanism movably resides. The slide mechanism is positionable by the user to any position along the length of the slot and includes a pin member projecting past the outside surface of the support arm.

Because there are a wide variety of shape, styles and materials of construction of existing toilet roll holder brackets, it is important for an adaptor to be easily adjustable to properly orient a roll of larger than conventional diameter at the desired elevation or dispensing angle. Most likely, the user will desire to support the roll such that the center of the roll at an elevation even with or slightly higher than where the conventional roll of toilet tissue was supported by the existing roll holder. The slide pin mechanism is used to position the pin member against the bottom surface of at least one of the arms of the existing roll holder to so orient the adapter so that a roll of greater than conventional diameter may be positioned at such desired elevation. In such manner, the slide pin mechanism allows the user to set a limit for the pivotal movement of the support arms and the telescoping cylinder due to gravity.

DETAILED DESCRIPTION OF THE PREFERRED EMBODIMENT

Figure 1:
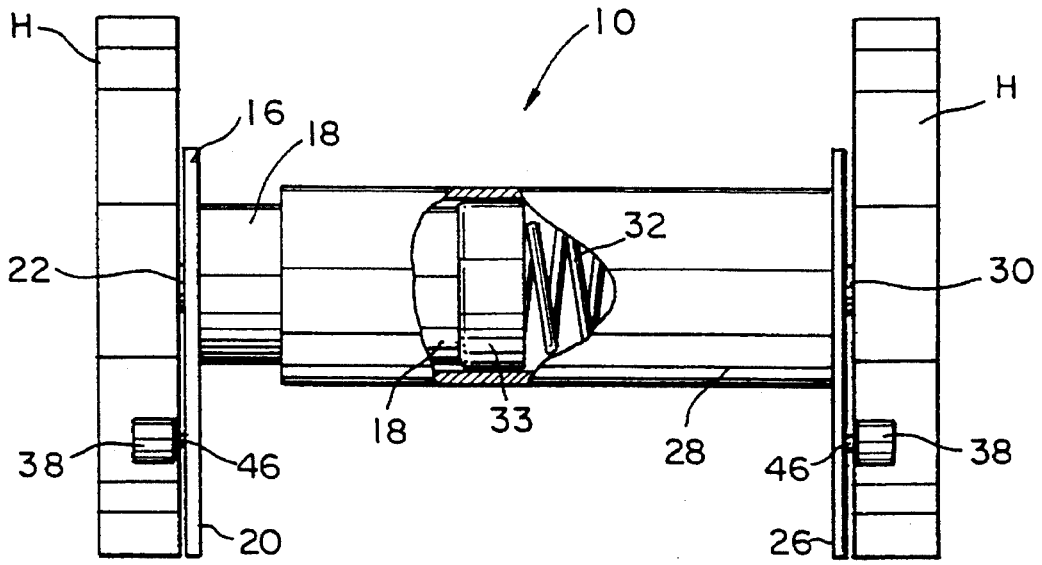
FIG. 1 is a front elevation of the tissue roll holder adaptor of the present invention installed on one shape of existing toilet roll holder which may be encountered.
Figure 2:
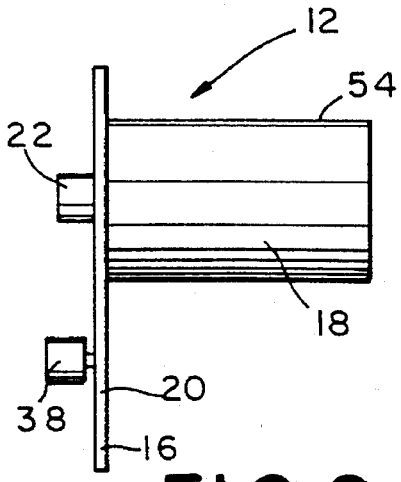
FIG. 2 is a front elevation of the left side member of the tissue roll holder adaptor of the present invention.

Turning first to FIG. 1 there is shown the adapter 10 of the present invention which is comprised of a left side member 12 and a right side member 14. The adaptor 10 is shown in FIG. 1 mounted in an existing toilet tissue roll holder H which is usually permanently affixed to a wall. Left side member 12 (see FIG. 2) includes left side plate 16 having tubular or cylindrical member 18 extending from the inside face 20 thereof. Extending from the outside face of left side plate 16 is journal 22.

Figure 3:
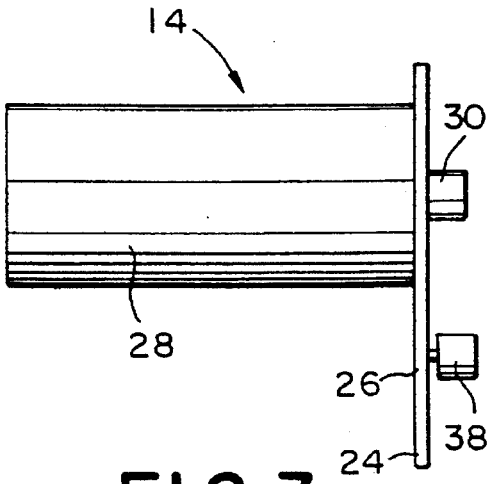
FIG. 3 is a front elevation of the right side member of the tissue roll holder adapter of the present invention.

Right side member 14 (see FIG. 3) includes a right side plate 24 which is preferably, a mirror image of left side plate 16. Projecting from the inside face 26 of right side plate 24 is tubular or cylindrical member 28 which has an inside diameter greater than the outside diameter of tubular member 18. In such manner, tubular member 18 can slide into and out of tubular member 28 in a telescoping-type fit. Projecting from the outside surface of right side plate 24 is journal 30. There is a compression spring 32 which resides within tubular member 28 held on one by a spring retainer 33 projecting from the inside surface 26 of right side plate 24. Attached to the opposite end of spring retainer 33 is piston 35 which movable resides within tubular member 28. Piston 35 provides a bearing surface against which the distal end of tubular member 18 presses when tubular member 18 is inserted into tubular member 28. In such manner, spring 32 acts to bias left side member 12 and right side member 14 in opposite directions or away from one another. Piston 35 is preferably cylindrical with one closed end and one open end with spring 32 inserting into the open end.

Figure 4:
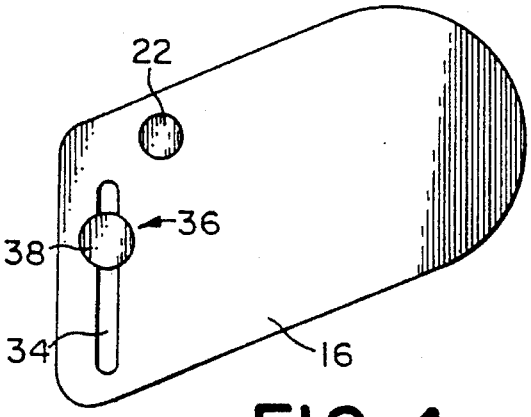
FIG. 4 is a side of the left side of the tissue roll holder adaptor of the present invention.
Figure 5:
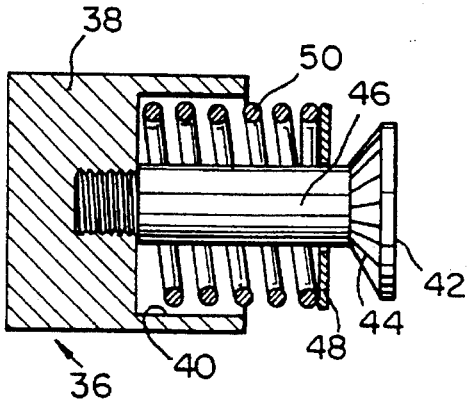
FIG. 5 is a partial section view of the slide pin mechanism of the present invention.
Figure 6:
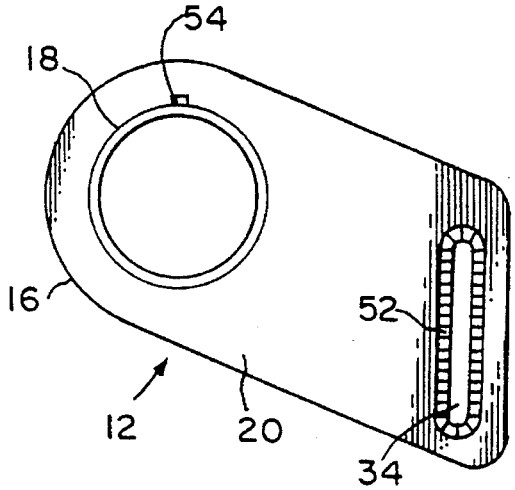
FIG. 6 is a side elevation of the inside face of the left side member of the present invention taken along line 6—6 of FIG. 2.
Figure 7:
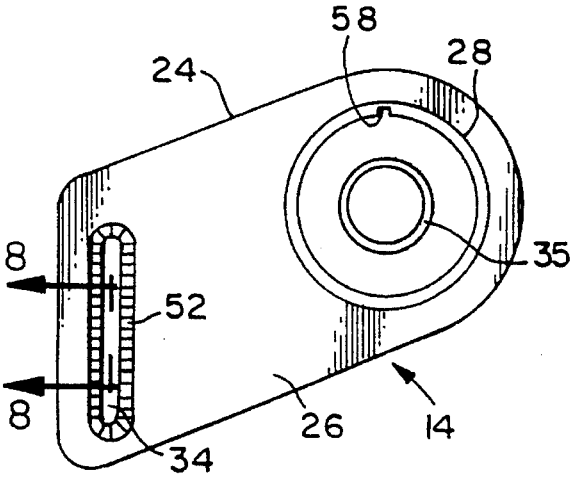
FIG. 7 is a side elevation of the inside face of the right side member of the present invention taken along line 7—7 of FIG. 3.
Figure 8:
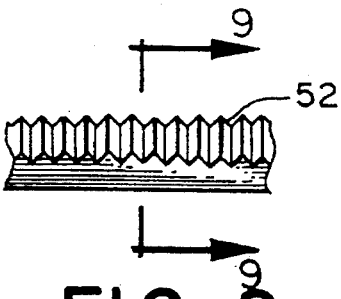
FIG. 8 is a partial elevational view taken along line 8—8 of FIG. 7.
Figure 9:
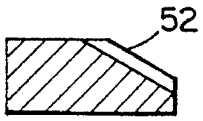
FIG. 9 is a sectional view taken along line 9—9 of FIG. 8.

Looking next at FIG. 4, which is a side elevation of the outside face of left side member 12, it can be seen that left side plate 16 includes a slot 34 therethrough. There is a slide pin mechanism 36 which engages left side plate 16 at slot 34. Shown in more detail in FIG. 5, slide pin mechanism 36 includes thole 38 having a cylindrical bore 40 partially therethrough. There is a screw 42 which threadably engages thole 38 and has a cylindrical axis which is substantially colinear with the cylindrical axis of cylindrical bore 40. Screw 42 is preferably in the form of a counter sunk flat fillister-head screw. Further, the conical surface 44 of the head of screw 42 is fluted such that the conical surface 44 resembles a bevel gear. The shank 46 of screw 42 inserts through a washer 48 and preferably includes a threaded portion to allow for attachment to thole 38. Residing between the washer 48 and the bottom of cylindrical bore 40 is an open helical compression spring 50. It will be recognized by those skilled in the art that screw 42 can be replaced by any shank and head configuration so long as means are provided for attaching the shank to thole 38. Thus, the shank may be a rod, threaded or unthreaded. It may attach to thole 38 by means of threads, glue, set screws, or the like. The shank may even be integrally formed with thole 38. The head used in conjunction with such shank may also be attached by similar means.

The area of inside surface 20 surrounding slot 34 is fluted. (See FIG. 6 through 9.) Further, such fluted area 52 is sloped to substantially match the angle of slope of the conical surface 44 of screw 42.

In order to position slide pin mechanism 36 at any particular location along slot 34, the user need merely push against thole 38 to overcome the bias of spring 50 and thereby disengage fluted conical surface 44 from fluted region 52. With such surfaces so disengaged, the user can then move the slide pin mechanism 36 to the desired location along slot 34 and release pressure against thole 38. Spring 50 then causes fluted conical surface 44 to re-engage with fluted region 52 thus locking slide pin mechanism 36 in its new location. In such manner, fluted conical surface 44 and fluted region 52 serve as an anti-slide means when thole 38 resides in its normal position.

Preferably, right side plate 24 (see FIG. 7) is a mirror image of left side plate 16 and includes its own slot 34 having an identical slide pin mechanism 38 residing therein. However, it will be recognized by those skilled in the art that the invention will effectively work with only a single slide pin mechanism 36.

Projecting from cylindrical surface 18 is guide nipple 54. There is a groove 58 (see FIG. 7) in the inside surface of cylinder 28. Groove 58 provides residence for alignment nipple 54 such that there is only a single orientation in which cylinder 18 can be inserted into cylinder 28. Slots 34 in fluted areas 52, combination with slide pins 36, allow the adaptor 10 of the present invention to support larger than conventional diameter rolls of tissue at a desired elevation from an existing toilet tissue roll holder. Further, the slide pin mechanism 36 allow the user to position and support the adapter 10 to a wide variety of shapes of existing toilet tissue roll holders. For example, looking next at FIG. 10, there is shown a side elevation of one particular shape for an existing toilet roll holder 70 extending out from a wall 72. By moving thole 38 toward the upper portion of slot 34, thole 38 prevents further pivoting of adapter 10 because thole 38 engages the bottom surface of arm 76 of the existing bracket 70. In such manner, telescoping cylindrical members 18, 28 which serve as the spindle or mandrel for supporting roll 74 are positioned at the desired elevation. As shown, the cylindrical axis of roll 74 has been placed at the same elevation as a convention roll would have been supported from existing bracket 70. However, the user may desire to slightly elevate roll 74 by moving thole 38 to a higher location along slot 34. The reason for possibly wanting to position roll 74 at a higher elevation is that, because roll 74 has a larger diameter than a conventional roll, the bottom of the roll would be slightly closer to the floor than that of a conventional diameter roll supported at the same elevation.

Figure 10:
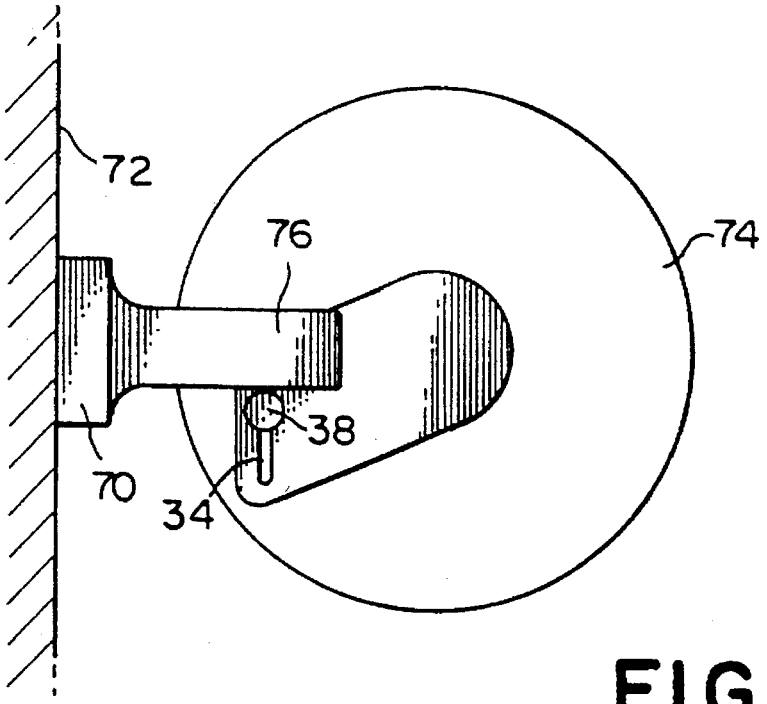
FIG. 10 is a side elevation of the adaptor of the present invention installed on one shape of existing toilet roll holder that may be encountered.
Figure 11:
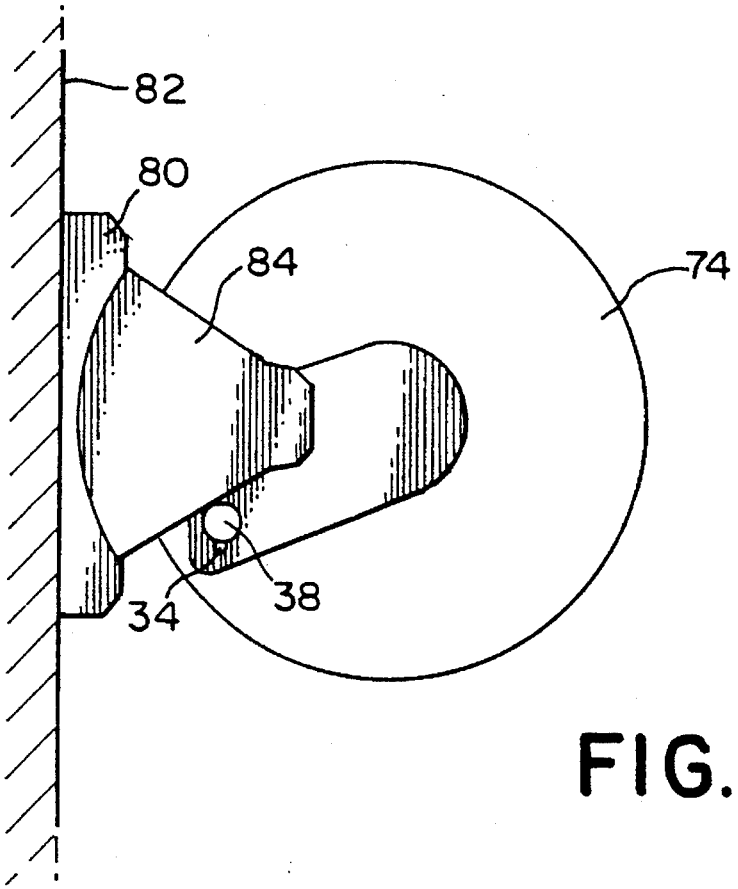
FIG. 11 is a side elevation of the adaptor of the present invention installed on another shape of existing toilet roll holder that may be encountered.

Looking next at FIG. 11, a side elevation of the adapter 10 of the present invention is shown mounted in another existing toilet tissue roll holder 80 extending from a wall 82. Toilet tissue roll holder 80 is similar in shape to that depicted in FIG. 1. The shape of arms 84 are much different that the shape of arm 76. As depicted, movement of thole 38 toward the lower end of slot 34 allows roll 74 to be supported at the same elevation as roll 74 was supported in FIG. 10.

The adaptor of the present invention has been depicted in FIGS. 1, 10 and 11 and described herein for use with existing toilet roll holder brackets which extend out from a wall. However, it will be recognized by those skilled in the art that the present invention can be easily modified for use with existing recessed toilet tissue holders. Basically, the only modification that need be made in such an instance is to re-orient the slot 34, preferably such that it is horizontal as opposed to vertical. In such manner, the thole 38 of slide pin mechanism 36 can be positioned along the slot such that it prevents further pivoting motion of the adaptor 10 by pressing against an outside vertical face of the existing toilet tissue holder, or against the wall in which the existing toilet tissue holder is recessed, again supporting the roll at the desired elevation. Further, the adaptor 10 of the present invention can be modified to be used both with existing tissue roll holders which extend out from walls and those which are recessed in walls by providing a slot 34 which is either T-shaped or L-shaped. The same capability might also be achieved by making slot 34 arcuate or, perhaps, at a 45° angle from the vertical.

Although the preferred anti-slide means of the present invention is preferably the fluted conical surface 44 and fluted region 52 described above, it will be recognized by those skilled in the art that there are numerous other configurations which will also serve as an anti-slide means. For example, region 52 may be a recessed shelf having a plurality of projections extending therefrom. The head of screw 42 may, in its normal position, rest between adjacent projections. Also, the head of screw may be a specific geometric shape such as square or rectangular and there could a series of mating indentations in region 52 along the length of slot 34 allowing for the movement of slide pin mechanism 36 to any one of such mating indentations. Additionally, the anti-slide means may merely by a locking-type nut attached to shank 46 which the user can fix in the desired location by finger tightening thole 38. This, however, would clearly not be a preferred anti-slide means.

The spindle or mandrel means of the present invention is described herein as tubular members 18, 28 which fit together in a telescoping-type configuration. As depicted, a user will have to completely separate such tubular members 18, 28 in order to load a roll of tissue thereon. If it desired not to have to separate the telescoping cylinder or mandrel in order to load a roll of tissue thereon, than the telescoping mandrel will have to be disengageable from one or both side plates 16, 24. Such a mandrel would, of course, have to have closed ends and a travel stop preventing separation of the tubular members by the force of spring 32. The mandrel could then be inserted into a cylindrical projection from one or both side plates. Engagement of the mandrel in such cylindrical projections could be by snap-fit or friction-fit. Such a snap-fit or friction-fit configuration could also be designed to work in conjunction with the mandrel of the existing toilet roll holder. However, since existing mandrels are not standardized in size and shape, this also would not be a preferred way of practicing the adaptor of the present invention.

In order to load a roll of tissue on the adaptor 10 of the present invention, the user will have to remove the adaptor 10 from the existing toilet roll holder. After placing a roll of tissue on the tubular members 18, 28, the user must reinstall the adaptor 10 onto the existing toilet roll holder. By applying pressure to side plates 16, 24 the user can compress spring 32. The user can then align journals 22, 30 with the holes or journal bearings of the existing holder and release pressure against side plates 16, 24 allowing journals 22, 30 to enter such holes thereby pivotally supporting adaptor 10 therefrom. The adaptor 10 will rotate downward due to gravity until tholes 38 contact a surface of the existing holder.

As used herein, a toilet tissue roll of conventional diameter means rolls having a diameter of from about 90 mm (3.54 in.) to about 140 mm (5.5 in.). As used herein, a toilet tissue roll of greater than conventional diameter generally means rolls having a diameter of at least 146 mm (5.75 in.).

From the foregoing, it will be seen that this invention is one well adapted to attain all of the ends and objects hereinabove set forth together with other advantages which are apparent and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. An adaptor for supporting rolls of toilet tissue of greater than conventional diameter, the adaptor being integratable with an existing toilet roll holder having a journal bearing on each side thereof for receiving the ends of a toilet roll holder mandrel, said adaptor comprising:

(a) spindle means for rotatably supporting a roll of toilet tissue of greater than conventional diameter, the roll of toilet tissue having a hollow core therethrough, said spindle means extending through the hollow core;

(b) a side member attached to each end of said spindle means;

(c) means for biasing said side members away from each other;

(d) a journal extending from each of said side members for insertion into the journal bearings of the existing toilet roll holder;

(e) a slot in at least one of said side members;

(f) a slide pin mechanism residing in said slot and including a thole extending therefrom, said slide pin mechanism being moveable to any position along said slot by a user, said thole abutting against a portion of the existing toilet roll holder to limit the amount of downward pivotal movement of said side members and said spindle means, said thole having a bore partially therethrough.

2. An adaptor for supporting rolls of toilet tissue of greater than conventional diameter, the adaptor being integratable with an existing toilet roll holder having a journal bearing on each side thereof for receiving the ends of a toilet roll holder mandrel, said adaptor as recited in claim 1 wherein:

said slide pin mechanism further includes (a) a shank affixed to said thole at a proximal end of said shank, said shank having a head means at a distal end thereof, said head means residing on the opposite side of said side member as said thole;

(b) a second biasing means located between said thole and said side member, said second biasing means causing said head means to a normal position abutting said side member;

(c) anti-slide means for preventing said slide pin mechanism from moving along said slot when said head means is in said normal position.

3. An adaptor for supporting rolls of toilet tissue of greater than conventional diameter, the adaptor being integratable with an existing toilet roll holder having a journal bearing on each side thereof for receiving the ends of a toilet roll holder mandrel, said adaptor as recited in claim 2 wherein:

said anti-slide means includes a fluted surface on said head means and a meshing fluted surface about the periphery of said slot.

4. An adaptor for supporting rolls of toilet tissue of greater than conventional diameter, the adaptor being integratable with an existing toilet roll holder having a journal bearing on each side thereof for receiving the ends of a toilet roll holder mandrel, said adaptor as recited in claim 2 wherein:

said anti-slide means includes a plurality of projections about the periphery of said slot, at least a portion of said head means residing between two of said projections when said head is in said normal position.

5. An adaptor for supporting rolls of toilet tissue of greater than conventional diameter, the adaptor being integratable with an existing toilet roll holder having a journal bearing on each side thereof for receiving the ends of a toilet roll holder mandrel, said adaptor as recited in claim 1 wherein:

said spindle means is a telescoping cylindrical member, said biasing means being a compression spring within said telescoping cylindrical member.

6. An adaptor for supporting rolls of toilet tissue of greater than conventional diameter, the adaptor being integratable with an existing toilet roll holder having a journal bearing on each side thereof for receiving the ends of a toilet roll holder mandrel, said adaptor comprising:

(a) spindle means for rotatably supporting a roll of toilet tissue of greater than conventional diameter, the roll of toilet tissue having a hollow core therethrough, said spindle means extending through the hollow core;

(b) a side member attached to each end of said spindle means;

(c) means for biasing said side members away from each other;

(d) a journal extending from each of said side members for insertion into the journal bearings of the existing toilet roll holder;

(e) a slot in each of said side members;

(f) a slide pin mechanism residing in each of said slots, each of said slide pin mechanisms including a thole extending therefrom, each of said slide pin mechanisms being moveable to any position along their respective said slots by a user, said tholes abutting against a portion of the existing toilet roll holder to limit the amount of downward pivotal movement of said side members and said spindle means, said thole having a bore partially therethrough.

* * * * *